United States Patent [19]

Ferrara

[11] 4,305,262

[45] Dec. 15, 1981

[54] JEWELRY WITH SLIDABLE, ADD-ON GEMS

[76] Inventor: Carl J. Ferrara, 104 Richards Ave., North Attleboro, Mass. 02761

[21] Appl. No.: 97,905

[22] Filed: Nov. 28, 1979

[51] Int. Cl.[3] ..... A44C 17/02; A44C 5/00

[52] U.S. Cl. ..... 63/29 R; 63/3

[58] Field of Search ..... 63/29 R, 20, 2, 1, 31, 63/4, 11; 40/622

[56] References Cited

U.S. PATENT DOCUMENTS

| | | | |
|---|---|---|---|
| 466,344 | 1/1892 | Groenman | 63/20 |
| 784,823 | 3/1905 | Whitsett | 63/1 R |
| 895,078 | 8/1908 | Döppenschmitt | 63/29 R |
| 1,578,461 | 3/1926 | Morris | 63/2 |
| 1,668,543 | 5/1928 | Anderson | 40/622 |
| 1,983,348 | 12/1934 | Dieges | 63/4 |
| 2,018,079 | 10/1935 | Macioci | 63/29 R X |
| 2,274,269 | 2/1942 | Jellinek | 63/1 R |
| 2,852,923 | 9/1958 | Gamelsky | 63/20 |
| 3,481,155 | 12/1969 | Cook | 63/2 |

FOREIGN PATENT DOCUMENTS

| | | | |
|---|---|---|---|
| 5842 | of 1893 | United Kingdom | 63/20 |
| 538528 | 8/1941 | United Kingdom | 63/20 |

*Primary Examiner*—F. Barry Shay

*Attorney, Agent, or Firm*—Harvey B. Jacobson

[57] ABSTRACT

An item of jewelry is disclosed which includes an elongated mounting base in the form of a straight, curved or angled bar, or the like, of polygonal cross-sectional configuration having one or a plurality of gems longitudinally slidably mounted thereon with each gem including a gem mount having a hollow passageway interfitting with the bar to provide sliding movement. The passageway in the gem mount is in the form of a split sleeve constructed of ductile metal to enable the sleeve to be placed onto the mounting bar and the opposed portions of the sleeve squeezed together by a suitable tool in order to close the split sleeve into close encircling relation to the bar thereby securely mounting the gem mount on the bar to enable the number of gems and gem mounts on the bar to be varied by adding on additional gems and gem mounts as desired by the purchaser or owner of the item of jewelry. Various types of gems or stones and metals normally employed in constructing fine jewelry are employed in constructing the jewelry item of the present invention.

2 Claims, 5 Drawing Figures

JEWELRY WITH SLIDABLE, ADD-ON GEMS

BACKGROUND OF THE INVENTION

1. Field of the Invention

The present invention generally relates to an item of jewelry and more specifically an item of jewelry in which gem mounts are slidably mounted on a supporting bar or base member with the structure of the gem mount enabling additional gems and gem mounts to be added onto the supporting bar either at the time of initial purchase or at a later time depending upon the desires of the purchaser or owner of the jewelry item.

2. Description of Relevant Art

Many jewelry items have been provided with various arrangements of gems and various patents disclose structures for mounting gems in a particular manner on a supporting structure which can be supported from the wearer of the jewelry item in various manners. In addition, various patents disclose structures to enable mounting of selective items, such as the initials of the wearer, on a mounting base in order to provide a custom-made jewelry item. The following U.S. patents are exemplary of the developments in this field of endeavor:

U.S. Pat. Nos:

1,756,448—Apr. 29, 1930
1,840,771—Jan. 12, 1932
2,022,397—Nov. 26, 1935
2,510,774—June 6, 1950
2,613,466—Oct. 14, 1952
2,721,398—Oct. 25, 1955
3,733,851—May 22, 1973.

SUMMARY OF THE INVENTION

An object of the present invention is to provide jewelry with a gem mount or mounts capable of being added to the item of jewelry for varying the appearance characteristics thereof and number of gems incorporated therein so that it may be custom-made for the purchaser or owner.

Another object of the invention is to provide jewelry in which a supporting base member is provided in the form of an elongated bar of polygonal cross section, preferably square, which is straight, arcuately curved, angled or otherwise formed into a desired configuration with each gem mount including a sleeve closely conforming with the cross-sectional configuration of the supporting base member and being longitudinally slidably mounted thereon.

A further object of the invention is to provide jewelry in accordance with the preceding objects in which the sleeve of the gem mount includes supporting prongs for engaging the gem in a conventional manner and the gem mount also includes a split sleeve which is constructed of ductile metal to enable the split sleeve to be positioned laterally onto the supporting base member when the edges of the split sleeve are moved away from each other after which the split sleeve can be squeezed into close encircling relation to the supporting bar to securely mount the gem on the bar but yet enabling it to slide to a desired location thereon thereby providing flexibility of the arrangement of a single gem on the bar or flexibility in the arrangement of multiple gems on the bar thereby enabling an article of jewelry to be custom-made for a customer or owner.

Still another object of the invention is to provide a jewelry item in accordance with the preceding objects in which the gems and the metal from which the components of the jewelry item are made are those which are conventionally employed in constructing fine jewelry with the structure being capable of incorporation into various types of jewelry, such as bracelets, necklaces, brooches, earrings, and the like.

Yet another object of the invention is to provide jewelry with slidable, add-on gems which is simple in construction, relatively easy to assemble but yet quite attractive in appearance.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
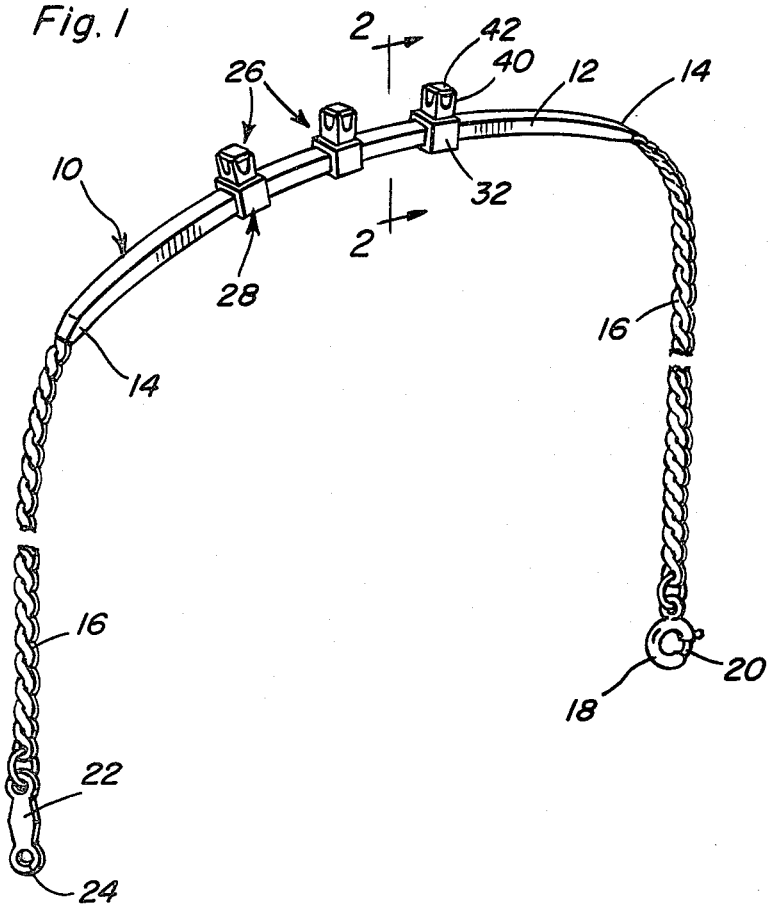
FIG. 1 is a perspective view of the jewelry item of the present invention.

Referring now specifically to the drawings, the item of jewelry is generally disclosed by reference numeral 10 and includes an elongated mounting base 12 in the form of an elongated bar of polygonal cross-sectional configuration, preferably square, although it can be rectangular or other conventional polygonal shapes. The cross-sectional configuration of the bar 12 is clearly illustrated in FIG. 2 and in the embodiment illustrated in the drawings, the bar 12 is slightly arcuately curved, although it can be substantially straight, angled or constructed in any suitable manner that provides an attractive appearance so that it can be used in various jewelry items. The ends of the bar 12 are tapered slightly as at 14 and a chain 16 is connected thereto in a secure manner with the chain 16 being of any suitable length depending upon the manner in which the jewelry item is to be used. The ends of the chain 16 are detachably interconnected by a conventional ring 18 having a spring closure 20 incorporated therein which is associated with a connector 22 which may be in the form of a jump ring or connector plate having an aperture 24 in the free end thereof for engagement by the spring ring 18 in a conventional manner. Other types of connectors such as clasps, hooks, and the like, may be employed to connect the ends of the chain 16 together and the chain is of decorative configuration and constructed of precious metal of the same type from which the bar 12 is made, such as gold, silver, platinum, and the like.

Figure 2:
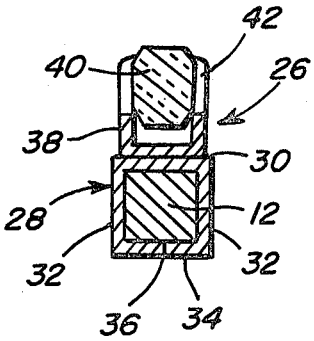
FIG. 2 is a transverse sectional view taken substantially upon a plane passing along section line 2—2 on FIG. 1 illustrating the structure of the mounting bar and gem mount with the split sleeve in close encircling relation to the mounting bar.

Mounted on the bar 12 is one or a plurality of gem mounts generally designated by the numeral 26 and which includes a sleeve 28 having a top wall 30, side walls 32 and a bottom wall 34, as viewed in FIG. 2, with the bottom wall 34 including a longitudinal slit therein thus defining a split sleeve. The top wall 30 is provided with a gem mounting base 38 having upwardly extending prongs 40 integral therewith which receive and engage a gem 42 to securely mount the gem 42 in a conventional manner. The gem 42 may be in the form of a diamond, ruby, emerald, sapphire, or other precious or semi-precious gem, and the gem mount 26 is constructed of the same metal as the bar 12.

Figure 3:
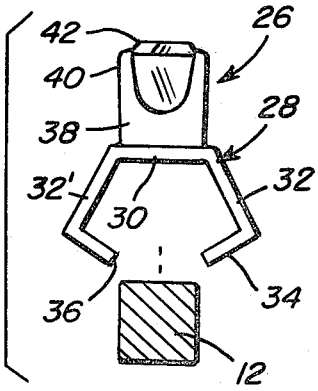
FIG. 3 is a sectional view similar to FIG. 2 but illustrating the split sleeve in its open condition so that it is capable of being laterally mounted onto the bar and then the split sleeve is squeezed to a close encircling relation to the mounting bar.
Figure 4:
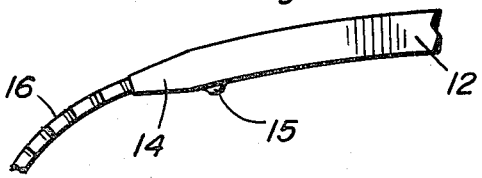
FIG. 4 is a fragmental elevational view illustrating one of the stops on the bar to retain the gem mounts thereon.

With the split sleeve in closed position, as illustrated in FIG. 2, the gem mount is securely retained in position on the bar 12 so that it cannot rotate about a longitudinal axis thereof but the gem mount is still capable of sliding on the bar 12 with the inherent friction between the gem mount 26 and the bar 12 serving to retain the gem mount in adjusted position on the bar 12. This construction enables any number and arrangement of gems to be placed on the bar 12 depending upon the desires of a purchaser or the desires of an owner, thus enabling a basic jewelry item, such as the bar and chain with one gem mounted thereon to be purchased and thereafter, additional gems may be added onto the bar 12 depending upon the desires of the owner. The jeweler having a supply of gem mounts and gems may easily provide a custom arrangement of gems on the bar 12 by merely placing the spread apart split sleeve onto the bar and then squeezing the sleeve with a suitable tool, similar to a pair of pliers, so that the edges of the slit 36 are brought into adjacent relationship, as illustrated in FIG. 2. FIG. 3 illustrates the relationship of the side walls 32 of the split sleeve 28 as the gem mount is assembled onto the bar, whereas FIG. 2 illustrates the final condition of the sleeve. The split sleeve need not be spread quite so far apart if it is placed over the chain or tapered end of the bar and then moved toward the central area thereof. Also, stops 15 are formed on each end of the inner surface of the bar 12, as shown in FIG. 4, to prevent movement of the mounts off the ends of the bar after assembly thereon. This stop may be formed by using an engraving tool or the like to form a small projection like a dimple on the inner surface of the bar 12.

Figure 5:
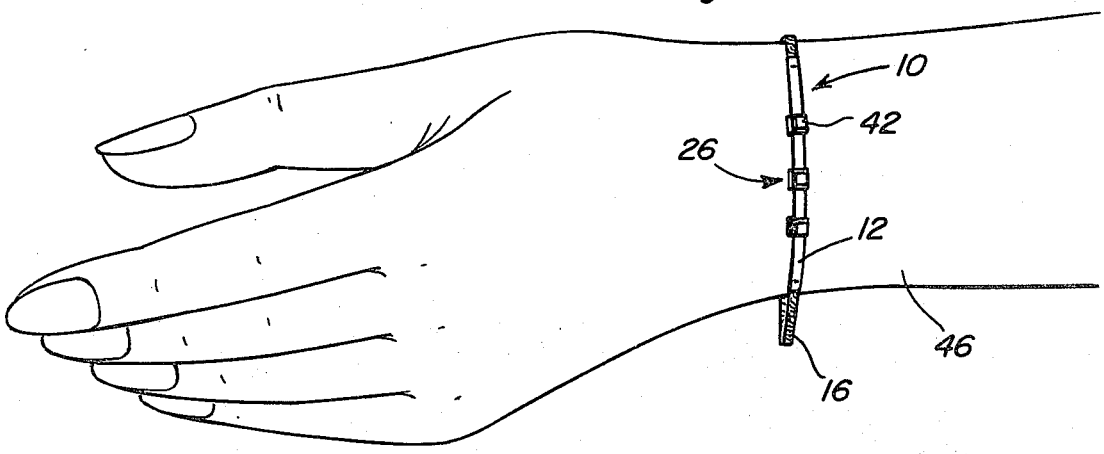
FIG. 5 is an elevational view of one embodiment of the jewelry item of the present invention in the form of a wrist encircling bracelet.

FIG. 5 illustrates one typical embodiment of the invention in the form of a bracelet in which the chain 16 is relatively short and the curvature of the bar 12 is such that it generally fits the curvature of the wrist area 44 of the wearer. With the chain 16 being substantially longer, the jewelry item 10 may be used as a necklace with the bar 12 generally forming a pendant. Depending upon the length of chain selected, the bar 12 may be disposed adjacent the front surface of the neck region of the wearer or it may depend into any desired elevational relationship to the chest region of the wearer. Also, the bar 12 may be in the form of a brooch with a suitable fastening clasp or other supporting structure on the inner surface thereof by which the item may be secured to various garments. Also, the bar 12 may be in the form earrings or other jewelry items curved or angulated in a particular manner, but with the bar 12 being polygonal and receiving one or more of the gem mounts.

This arrangement enables a prospective customer to obtain a custom-made item of jewelry having unique appearance characteristics and provides the capability of altering the uniqueness of the appearance characteristics. For example, with a single gem mount on the bar 12 and the item being in the form of a necklace, the wearer of the necklace can attract attention to the item of jewelry by orienting the gem mount 26 in offset relation, that is, toward one end of the other of the bar 12. Such an arrangement will entice others to observe and comment upon the item of jewelry. Also, by using multiple gem mounts, they may be slidable into juxtaposed relationship to each other or they may be spread apart in any desired manner and the number of the gem mounts may be varied depending upon the customer's wishes using all similar stones or different stones to enhance the appearance characteristics of the device and to enable birthstones, or the like, to be incorporated therein. For example, the gems in the gem mounts may designate the birthstones of the children of a wearer and/or the birthstones of a husband and wife or other family groups.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A jewelry item comprising an elongated supporting member, means on said supporting member for supporting it from a wearer, and at least one gem and gem mount mounted on said supporting member, said gem mount including a mounting base and prong means for supporting the gem and a split sleeve, said split sleeve having a longitudinal slit in a wall portion opposed to the mounting base enabling lateral assembly of the gem mount onto the supporting member when the split sleeve is spread apart with the split sleeve securing the gem mount on the supporting member when closed, said slit being defined by abutting end edges of the wall portion, said wall portion being constructed of ductile metal, said supporting member being an elongated rigid bar of polygonal cross-sectional configuration and having a constant cross-sectional area over a major portion of its length, said sleeve having an internal configuration corresponding to and closely conforming to the bar to prevent rotation of the gem and gem mount about the longitudinal axis of the bar while enabling sliding adjustment along the length of the bar, said supporting means including chain segments having a smaller cross-sectional area than the bar with each chain segment having one end fixedly secured to an end of the bar, the end portions of the bar tapering to provide a gradual and smooth transition from the bar to the chain segments with the chain segments forming an axial continuation of the tapered end portions, and fastener means detachably connecting the other ends of the chain segments to mount the item of jewelry in encircling relation to a portion of the anatomy of a wearer, said bar being curved with the convex surface having the gem projecting therefrom, the inner concave surface of the bar being provided with a projecting limit stop adjacent each tapered end portion of the bar to prevent the gem mount from sliding off the end of the bar onto the chain segments.

2. The jewelry item of claim 1 wherein a plurality of gems and gem mounts are mounted on said bar by a jeweler thereby enabling the jewelry item to be custom-made or additional gems to be added on after purchase by placing the open split sleeve over the bar and squeezing the split sleeve into closed condition.

* * * * *